US009962826B1

(12) United States Patent
Surridge

(10) Patent No.: US 9,962,826 B1
(45) Date of Patent: May 8, 2018

(54) TOOL CABINET AND STORAGE ASSEMBLY

(71) Applicant: Conestoga Products, Inc., Hickory, NC (US)

(72) Inventor: David G. Surridge, Hickory, NC (US)

(73) Assignee: Conestoga Products, Inc., Hickory, NC (US)

( * ) Notice: Subject to any disclaimer, the term of this patent is extended or adjusted under 35 U.S.C. 154(b) by 0 days. days.

(21) Appl. No.: 15/093,017

(22) Filed: Apr. 7, 2016

Related U.S. Application Data

(60) Provisional application No. 62/161,281, filed on May 14, 2015.

(51) Int. Cl.

| | |
|---|---|
| ***A47B 81/00*** | (2006.01) |
| ***B25H 3/02*** | (2006.01) |
| ***A47B 88/04*** | (2006.01) |
| ***A47B 96/06*** | (2006.01) |
| ***A47B 95/00*** | (2006.01) |
| ***A47B 95/02*** | (2006.01) |

(52) U.S. Cl.
CPC ..... *B25H 3/028* (2013.01); *A47B 81/00* (2013.01); *A47B 88/04* (2013.01); *A47B 95/008* (2013.01); *A47B 95/02* (2013.01); *A47B 96/06* (2013.01); *A47B 2095/024* (2013.01)

(58) Field of Classification Search
CPC ..... B25H 3/028; A47B 81/00; A47B 88/04; A47B 95/02; A47B 95/008; A47B 96/06
USPC ..... 312/330.1, 334.7, 294, 237, 290
See application file for complete search history.

(56) References Cited

U.S. PATENT DOCUMENTS

| | | | | | |
|---|---|---|---|---|---|
| 3,760,943 | A * | 9/1973 | Reader | B07C 7/02 | 209/546 |
| 4,010,989 | A * | 3/1977 | Klug | A47B 88/944 | 312/204 |
| 4,168,103 | A | 9/1979 | Hagen | | |
| 4,352,529 | A | 10/1982 | Steinke | | |
| 4,605,266 | A | 8/1986 | McKernan et al. | | |
| 4,705,326 | A | 11/1987 | Craig | | |
| 4,721,347 | A | 1/1988 | Kritselis | | |
| 4,761,045 | A | 8/1988 | Paine | | |
| 5,244,265 | A * | 9/1993 | Chiang | B25H 3/023 | 312/107 |
| 5,257,860 | A | 11/1993 | Silvon | | |
| 5,358,322 | A | 10/1994 | McLaughlin | | |
| 5,443,311 | A * | 8/1995 | Kadlecek | B25H 1/12 | 108/90 |

(Continued)

*Primary Examiner* — James O Hansen
(74) *Attorney, Agent, or Firm* — Shuttleworth & Ingersoll, PLC; Jason Sytsma

(57) ABSTRACT

A body comprising an internal cavity and a pair of support brackets mounted to a support brackets on opposite sides of the internal cavity. A drawer is engagable with the pair of support brackets for movement with the pair of support brackets from a closed position to an open position. A lid assembly comprising a lid is configured for selectively covering an inside of the drawer. A first latch is configured for moving between a first position for securing the lid to the body and a second position for securing the lid to the drawer, wherein in the first position the drawer moves with respect to the lid to the open position so that the inside of the drawer is exposed, and wherein in the second position the drawer moves with the lid toward the open position so that the drawer and the lid can be removed from the body.

14 Claims, 21 Drawing Sheets

(56) References Cited

U.S. PATENT DOCUMENTS

| | | | | |
|---|---|---|---|---|
| 5,567,027 | A | 10/1996 | McClung et al. | |
| 5,603,559 | A * | 2/1997 | Yemini | B25H 3/028 220/4.27 |
| 5,607,213 | A | 3/1997 | Slivon et al. | |
| 5,720,535 | A | 2/1998 | Mehman | |
| 5,862,689 | A | 1/1999 | Wen | |
| 6,244,064 | B1 * | 6/2001 | Powell | A45C 15/00 62/331 |
| 6,347,848 | B1 | 2/2002 | Cho | |
| 6,572,203 | B1 | 6/2003 | Cheng | |
| 6,726,294 | B1 | 4/2004 | Muller et al. | |
| 6,736,265 | B2 | 5/2004 | Kipper et al. | |
| 6,811,232 | B2 | 11/2004 | Doan et al. | |
| 6,877,829 | B2 | 4/2005 | Irizarry | |
| 6,932,444 | B2 | 8/2005 | Price | |
| 6,997,527 | B2 | 2/2006 | Cheng | |
| 7,264,319 | B2 | 9/2007 | Cheng | |
| RE40,267 | E | 4/2008 | Mehmen | |
| 7,461,908 | B1 | 12/2008 | Heiligenthal et al. | |
| 7,494,171 | B2 | 2/2009 | Martin et al. | |
| 7,946,663 | B2 | 5/2011 | Holcomb | |
| 8,348,357 | B2 | 1/2013 | Briggs | |
| 8,554,364 | B2 * | 10/2013 | Holmes | A47B 88/00 700/232 |
| 8,613,456 | B2 | 12/2013 | Grela et al. | |
| 8,770,680 | B1 | 7/2014 | Chen et al. | |
| 8,870,308 | B2 | 10/2014 | Freimuth | |
| 8,870,312 | B2 | 10/2014 | Tosin | |
| 2011/0074262 | A1 * | 3/2011 | Liu | B25H 3/028 312/334.1 |
| 2013/0118818 | A1 * | 5/2013 | Smith | B25H 1/04 180/19.1 |
| 2014/0123478 | A1 * | 5/2014 | Gylander | B25H 3/02 29/700 |

* cited by examiner

TOOL CABINET AND STORAGE ASSEMBLY

This application claims priority to U.S. Provisional Patent Application 62/161,281 filed May 14, 2015 the contents of which are hereby incorporated by reference herein.

BACKGROUND

Toolbox assemblies are used to selectively store tools such as woodworking tools, auto repair tools, etc. and are available in various configurations and sizes. Many of these storage assemblies include a number of drawers designed to slide in and out of a stationary cabinet. Other storage assemblies are intended to be portable and include carrying handles, trays, etc. While these storage devices do provide adequate storage for such items they also have numerous deficiencies. Tool storage cabinets with sliding drawers generally offer a large amount of potentially well-organized storage. However, it can often be necessary to remove various tools from such a storage device to be carried to a remote location for use. The transport of these tools may often require transferring them to a smaller, portable tool holder. Portable tool storage devices help solve this issue by providing a way to transport tools. However, they are generally smaller than the tool storage cabinets with sliding drawers and thus are unable to store the same variety and amount of tools. It can often be the case that such a portable tool box does not include the appropriate tool for a particular task requiring access to a larger and more complete selection of tools which is potentially stored in a sliding drawer tool storage cabinet. Consequently, tool users will often maintain both types of tool storage devices.

It would therefore be desirable to have a single tool storage device that addresses the above deficiencies. Such a device would provide the advantages of a tool storage cabinet with drawers such as the capability to store a large volume and variety of tools. This tool storage device would also provide a way to transport the desired tool selections to remote locations.

The invention disclosed herein overcomes these deficiencies associated with existing tool storage solutions.

SUMMARY OF THE INVENTION

A tool cabinet is disclosed comprising an internal cavity and a pair of support brackets on opposite sides of the internal cavity. A drawer is engagable with the pair of support brackets for movement with the pair of support brackets from a closed position to an open position. A lid assembly further comprising a lid is configured for selectively covering an inside of the drawer. A first latch is configured for moving between a first position for securing the lid to the body and a second position for securing the lid to the drawer, wherein in the first position the drawer moves with respect to the lid to the open position so that the inside of the drawer is exposed, and wherein in the second position the drawer moves with the lid toward the open position so that the drawer and the lid can be removed from the body.

A storage assembly is further disclosed. The storage assembly comprises the tool cabinet and a rack positioned apart from the tool cabinet for receiving the drawer with the lid secured thereto. The storage assembly enables hanging the drawers on such things as inside truck boxes, on racks mounted to ATVs, etc.

DETAILED DESCRIPTION OF THE PREFERRED EMBODIMENT

In the following description the term "cabinet" is used to include a variety of storage devices including but not limited to chests, floor or caster mounted cabinets, carts, tool boxes, etc. Thus, in the claims, the term "cabinet" is to be defined in the broadest sense possible to include such things as cabinets, carts, chests, boxes and the like.

Figure 1:
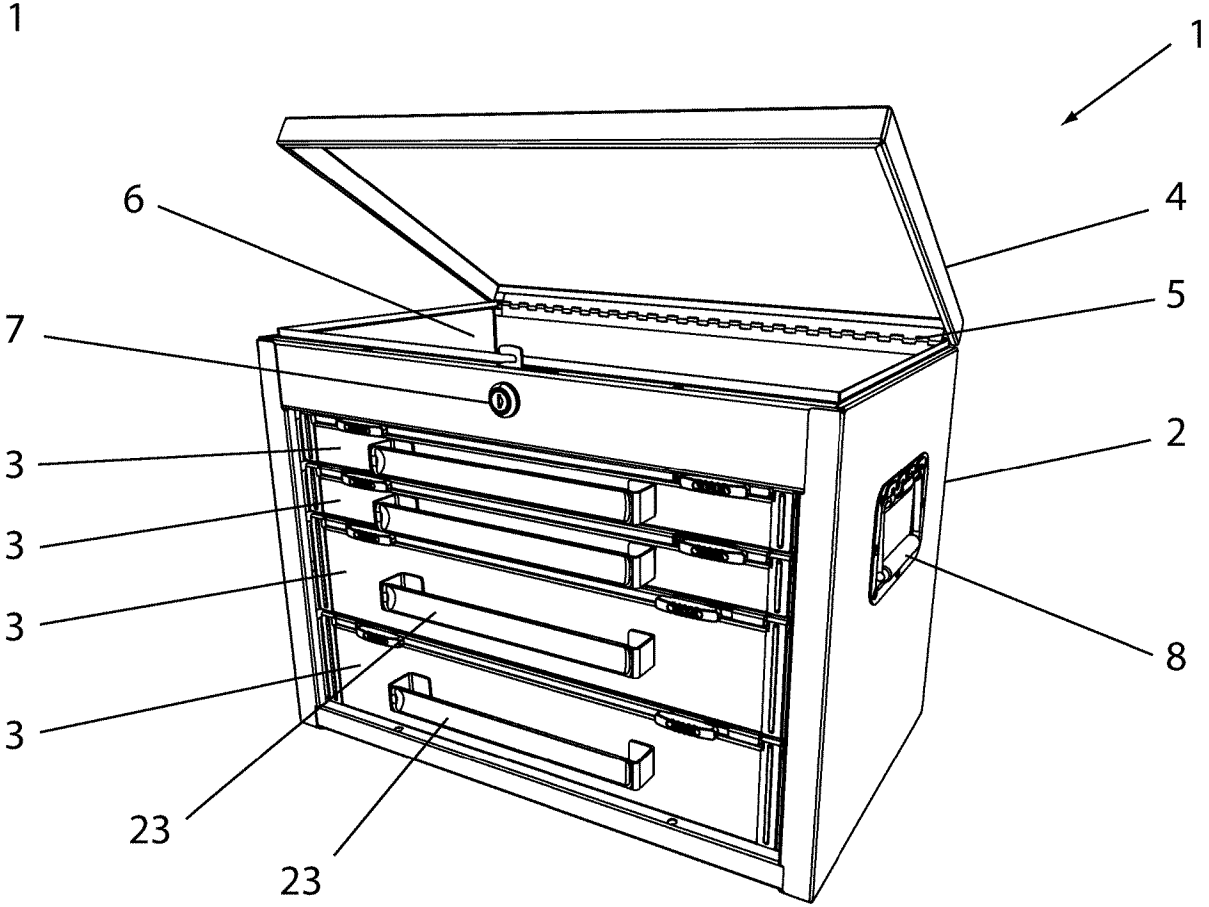
FIG. 1 is a perspective view of a tool storage cabinet including a number of drawers.

Referring now to FIG. 1, there is shown a tool cabinet 1 made according to accepted engineering and manufacturing practices. The tool cabinet 1 includes a body 2 with an internal cavity with multiple members and is adapted to selectively, movably and removably receive a plurality of drawer assemblies 3.

The tool cabinet 1 includes a top lid 4 designed to open by way of a hinge 5 along the top rear edge of the cabinet to provide access to a top storage compartment 6 in the tool cabinet 1. The tool cabinet 1 also includes a way to secure the top storage compartment 6 by way of a keyed lock 7. Additionally, handles 8 are included on the opposing sides of the tool cabinet 1 to provide a way to move the tool cabinet 1 in its entirety between locations. Finally, in FIG. 1, a plurality of drawer assemblies 3 can be seen within the body 2 of the tool cabinet 1.

Figure 2:
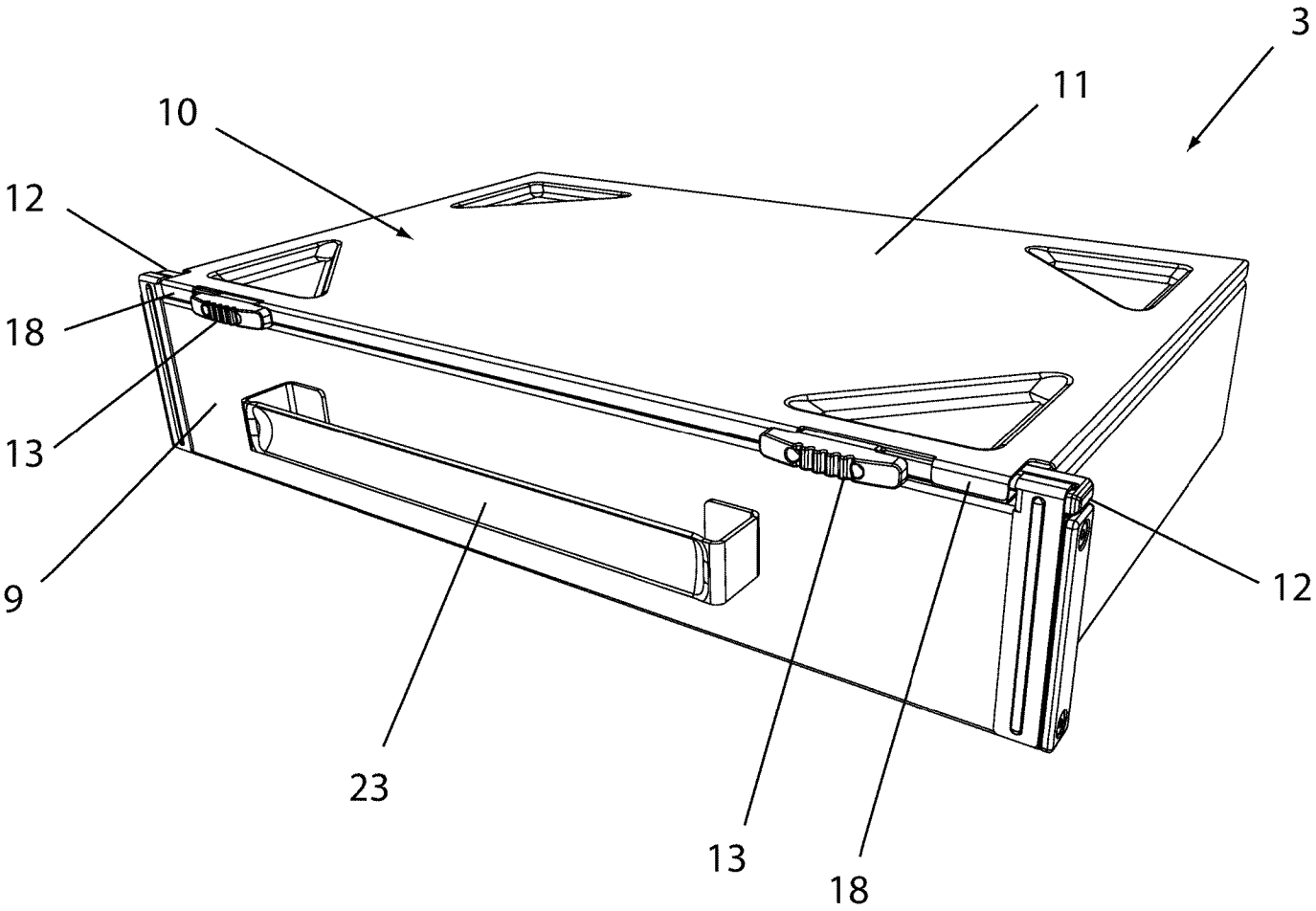
FIG. 2 is a perspective view of the drawer assembly removed from the storage cabinet and showing the lid secured to the drawer by the latch mechanism as well as the features on the exterior of the drawer to hang drawer as described in preferred embodiment
Figure 3:
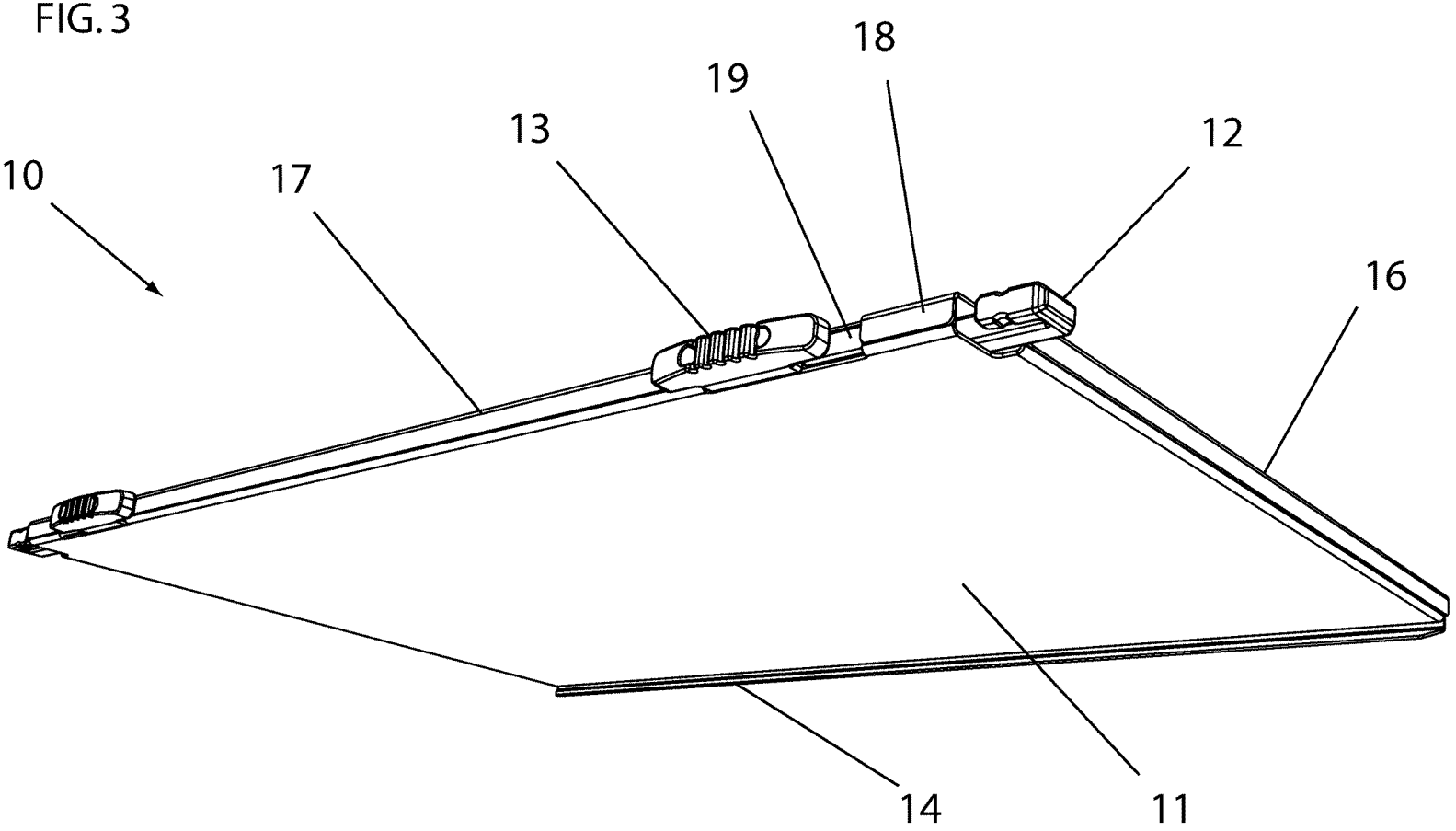
FIG. 3 is a perspective view of the lid assembly removed from the drawer assembly

Shown in FIG. 2 is a drawer assembly 3 which includes a drawer 9 (shown in FIG. 4) and a lid assembly 10 (shown in FIG. 3).

As shown in FIG. 3, the lid assembly 10 is comprised of a plurality of components including a selectively formed lid 11*a* latch (that can be configured as a linearly movable latch bar 12 or a rotating latch hook 42) and a tab 13. The lid 11 includes a flange 14 downturned to an acute angle at the rear edge which provides a way of engaging a corresponding formed edge 15 on the top rear edge of the drawer 9. The opposing sides of the lid 11 include formed edges 16 as a way to contribute to the stiffness of the lid. The front edge of the lid 11 includes a formed edge 17 similar to formed edges 16 serving the same purpose. The construction of the lid is such that a passage in the form of a channel 18 is created through which the latch bars 12 are free to slide. Finally, the tab 13 is fastened to the latch bar 12 through a slotted opening 19 on the front of the channel 18 limiting the sliding motion of the latch bar 12 to a predetermined range of motion. While the drawings show two latching mechanisms, one latching mechanism could potentially be used. Furthermore, lid 11 could be formed as two lid sections, inner and outer formed lids that are combined together.

Figure 4:
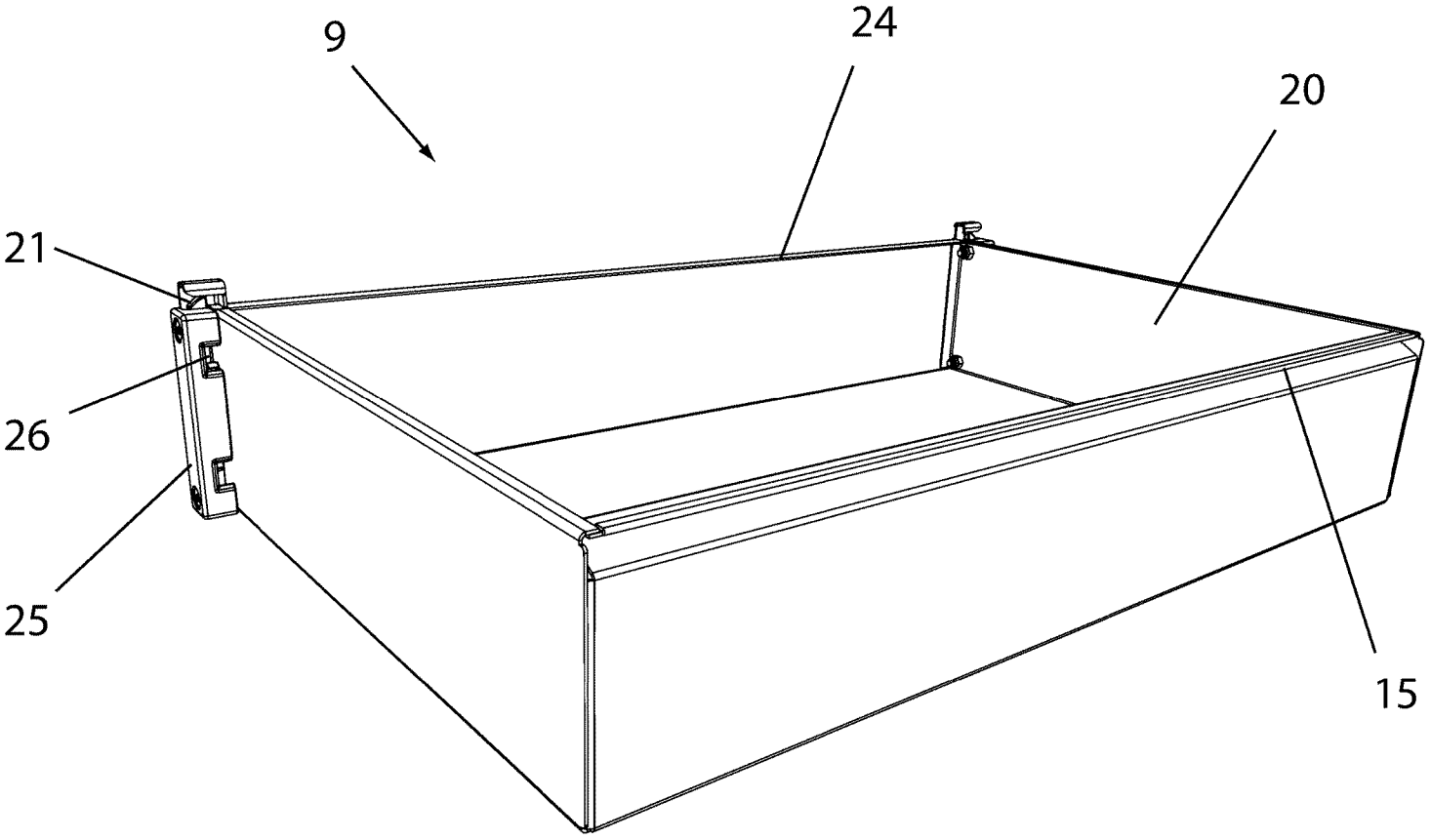
FIG. 4 is a perspective view of the drawer with lid removed showing drawer features.

FIG. 4 shows a drawer 9 or the drawer assembly 3 of FIG. 2 with the lid assembly 10 removed. The drawer 9 includes the drawer base 20, slide release latches 21, slide release springs 22, a handle 23, and a front flange 24. The formed edge 15 of drawer base 20 is intended to removably receive and secure the downturned flange 14 on the lid 11 of lid assembly 10. Also included on opposing front edges of the drawer base 20 are extensions 25 to provide the way to hang the drawer assembly 3 in any of the numerous ways described below. The extensions 25 also provide the enclosure for both the slide release latches 21 and the slide release springs 22. On the rear side of the extensions 25 are provided openings 26 through which tab 28 on support bracket 27 passes when the drawer assembly 3 is installed in the tool cabinet 1.

Figure 5:
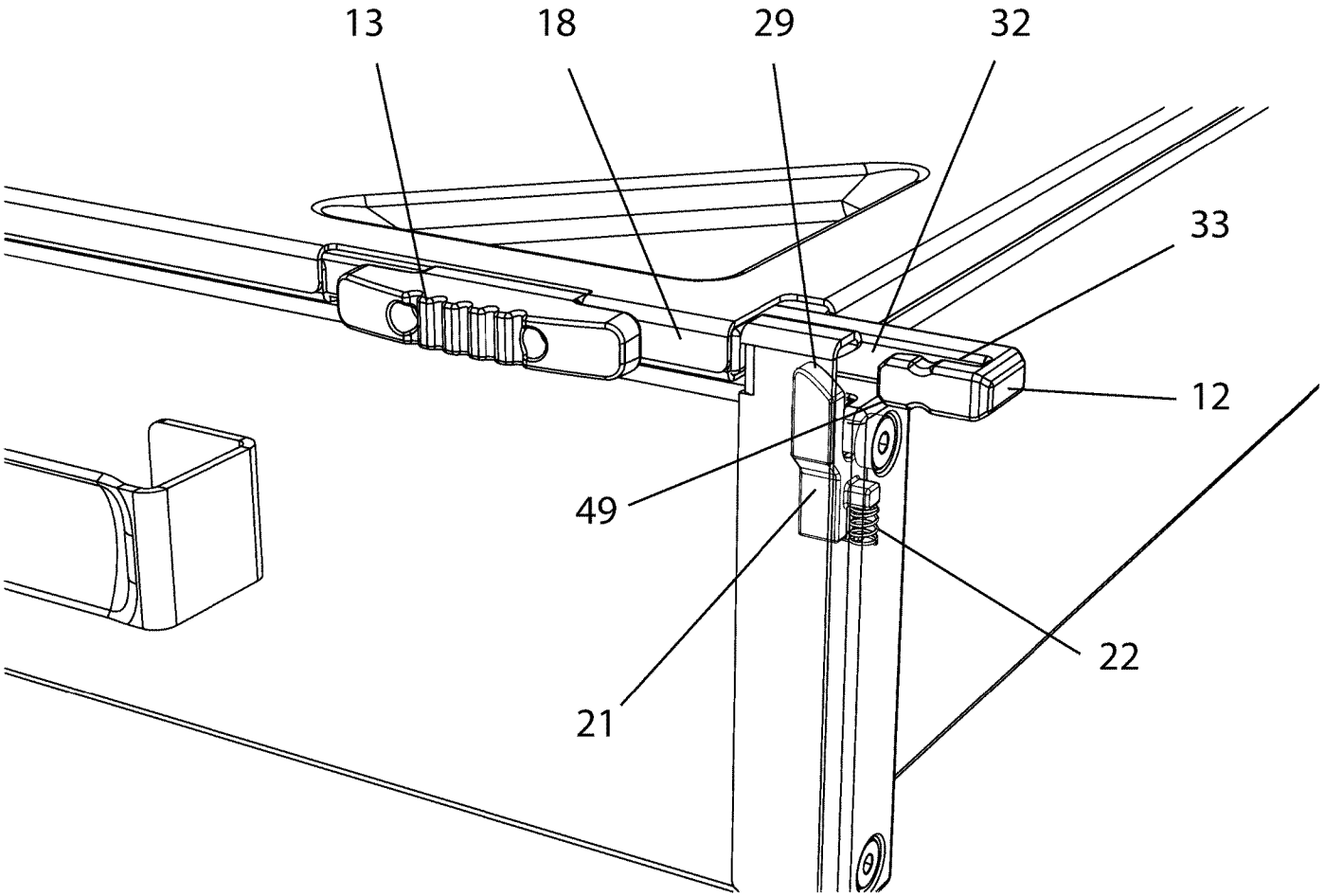
FIG. 5 is a perspective view with the drawer end pieces shown in hidden line showing the latch mechanism which secures the lid to the drawer, secure lid to outer cabinet, and releases the drawer from drawer slides.

FIG. 5 shows a detailed view of the slide release latch 21, slide release spring 22 configured to bias the slide release latch 21, as well as the latch bar 12 and tab 13. The latch bar 12 is shown in a first position in which it would be engaged with the corresponding hole 35 in the body 2 thus securing the lid assembly 10 inside the body 2 of tool cabinet 1. The slide release latch 21 includes an inclined protrusion 29 which will be contacted by a camming surface 49 on latch bar 12 and forced in a downward direction when the latch bar 12 is slid in toward a second position in an inward direction. In this second position the lid assembly 10 is latched to the drawer 9 and the drawer assembly 3 is released from the pair of support brackets 27, which are each mounted on a sliding track, and may be removed from the body 2 or conversely installed in the body 2.

Figure 6:
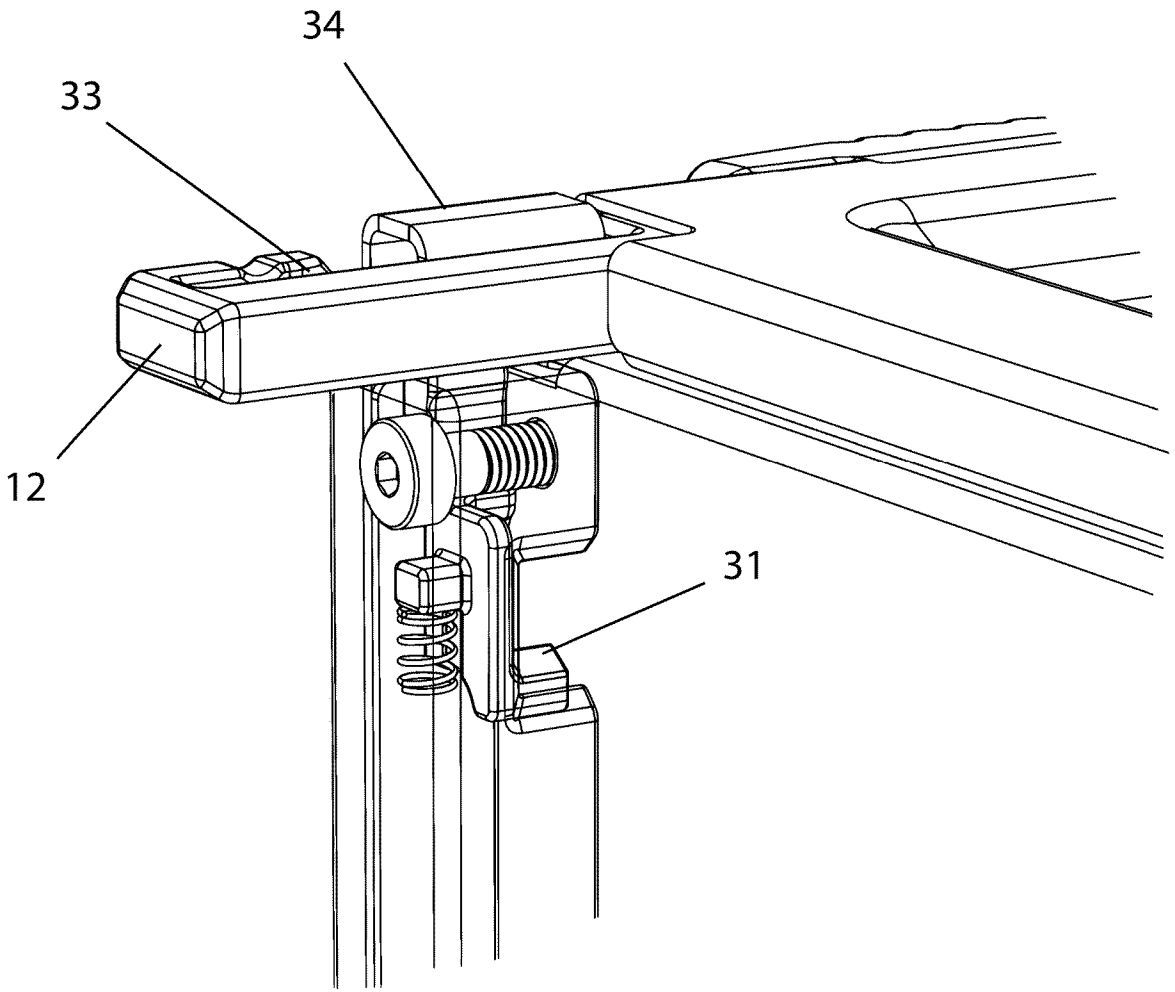
FIG. 6 is an enlarged perspective view showing a different view of the latching mechanism with the drawer end piece shown in hidden line for purposes of clarity

FIG. 6 shows that slide release latch 21 includes a second protrusion 31 that engages the notch 30 on the tab 28 formed on the support bracket 27. This engagement between the second protrusion 31 and notch 30 is selectively engaged and disengaged by the latch bar 12. When the latch bar 12 is slid in an outward direction to the first position, thus engaging the body 2 with the latch bar 12, the slide release latch 21 is allowed to rise by the slide release spring 22 into the gap 32 formed into the latch bar 12 thus allowing the second protrusion 31 to engage notch 30 and securing the drawer 9 to the support brackets 27. When the latch bar 12 is slid to the second position in an inward direction, the groove 33 in the top of latch bar 12 will engage a securing member 34, which can be a channel, hook or other similar feature thus securing the lid assembly 10 to the drawer 9 while also simultaneously releasing the drawer assembly 3 from the support brackets 27 by way of depressing the slide release latch 21. This single movement of latch bar 12 also disengages latch bar 12 from the corresponding hole 35 in the body 2 allowing the drawer assembly 3 to be removed from the body 2.

More specifically, a single movement of the latch bar 12 to the first position simultaneously secures the lid 11 to the body 2 and secures the drawer 9 to one of the support brackets 27. Also, a single movement of the latch bar 12 to the second position simultaneously secures the lid 11 to the drawer 9 and disengages the drawer 9 from the support brackets 27.

Figure 7:
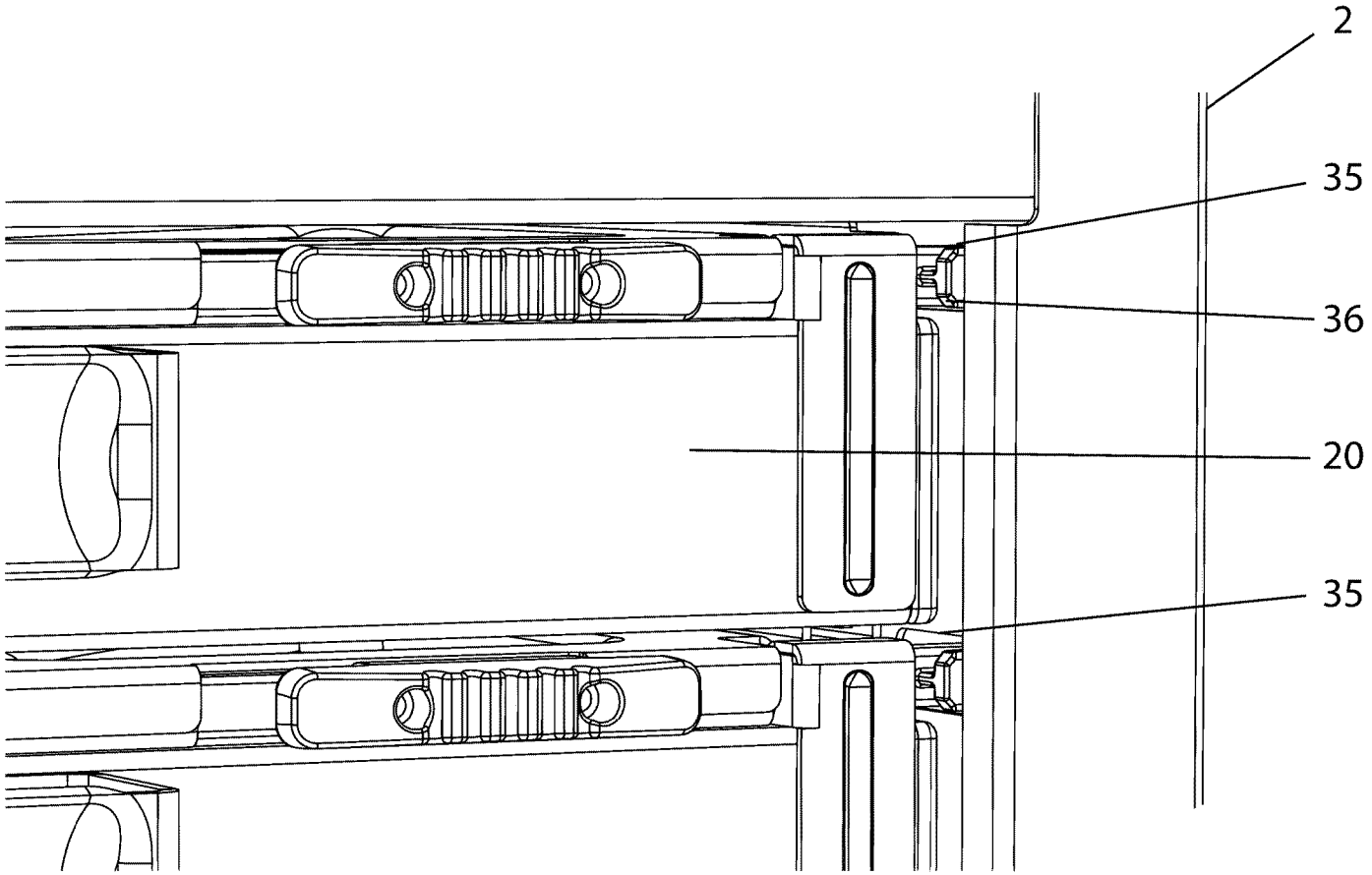
FIG. 7 is an enlarged perspective view showing the engagement of the lid latch to the body of the cabinet for securing lid to cabinet.

FIG. 7 shows a detailed view of the latch bar 12 while engaged in the corresponding hole 35 in the body 2. In this configuration the protrusion 29 of the slide release latch 21 fits in the notch 30 of the latch bar 12 In this configuration the lid assembly 10 is retained in the body 2 and the drawer 9 is latched to the support brackets 27 allowing the drawer 9 to slide in and out of the body 2 by way of the drawer slides 36 (shown in FIG. 8) to which the support bracket 27 is attached.

Figure 9:
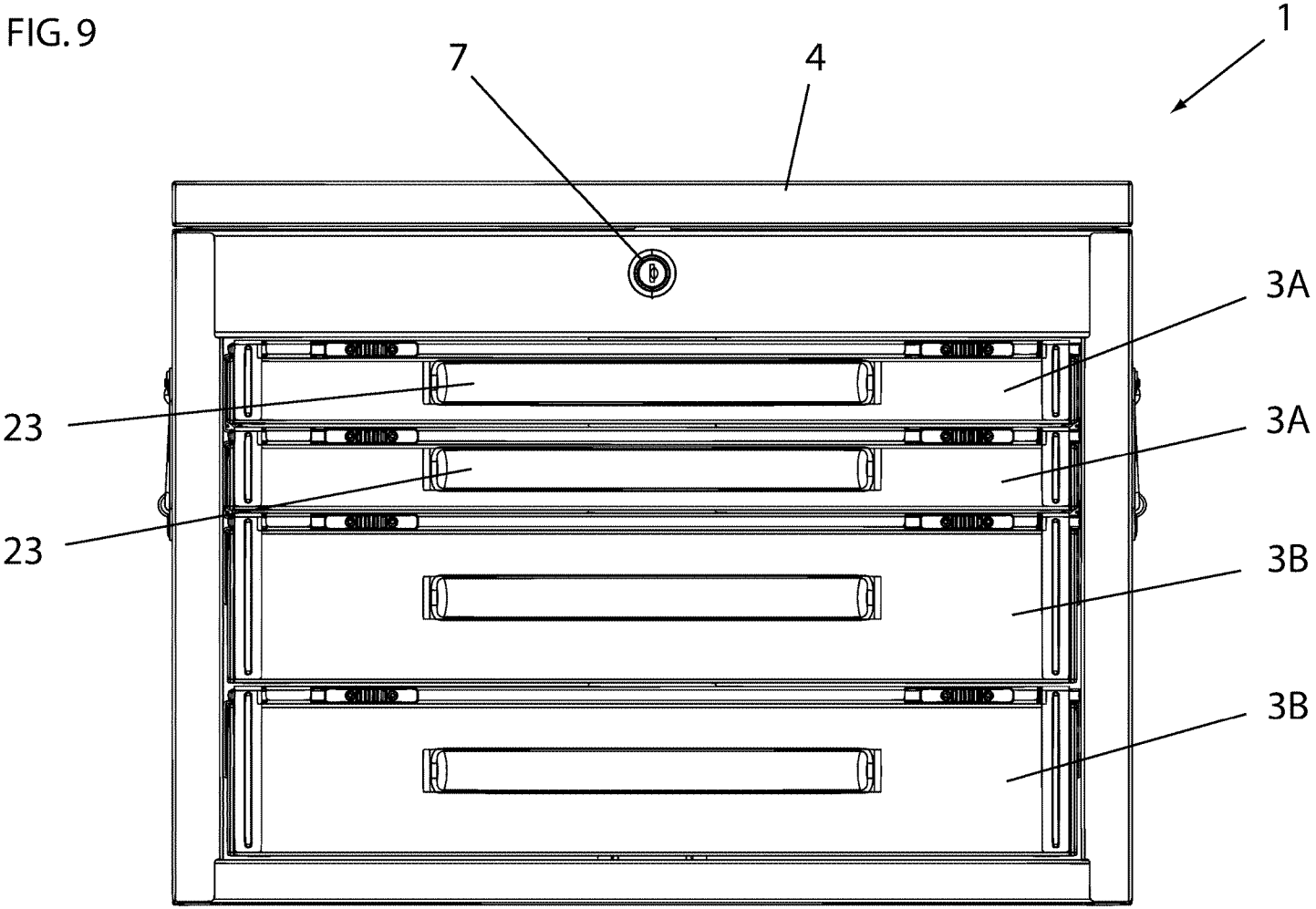
FIG. 9 is a front view of the storage cabinet with one variation of drawers installed in one configuration.
Figure 10:
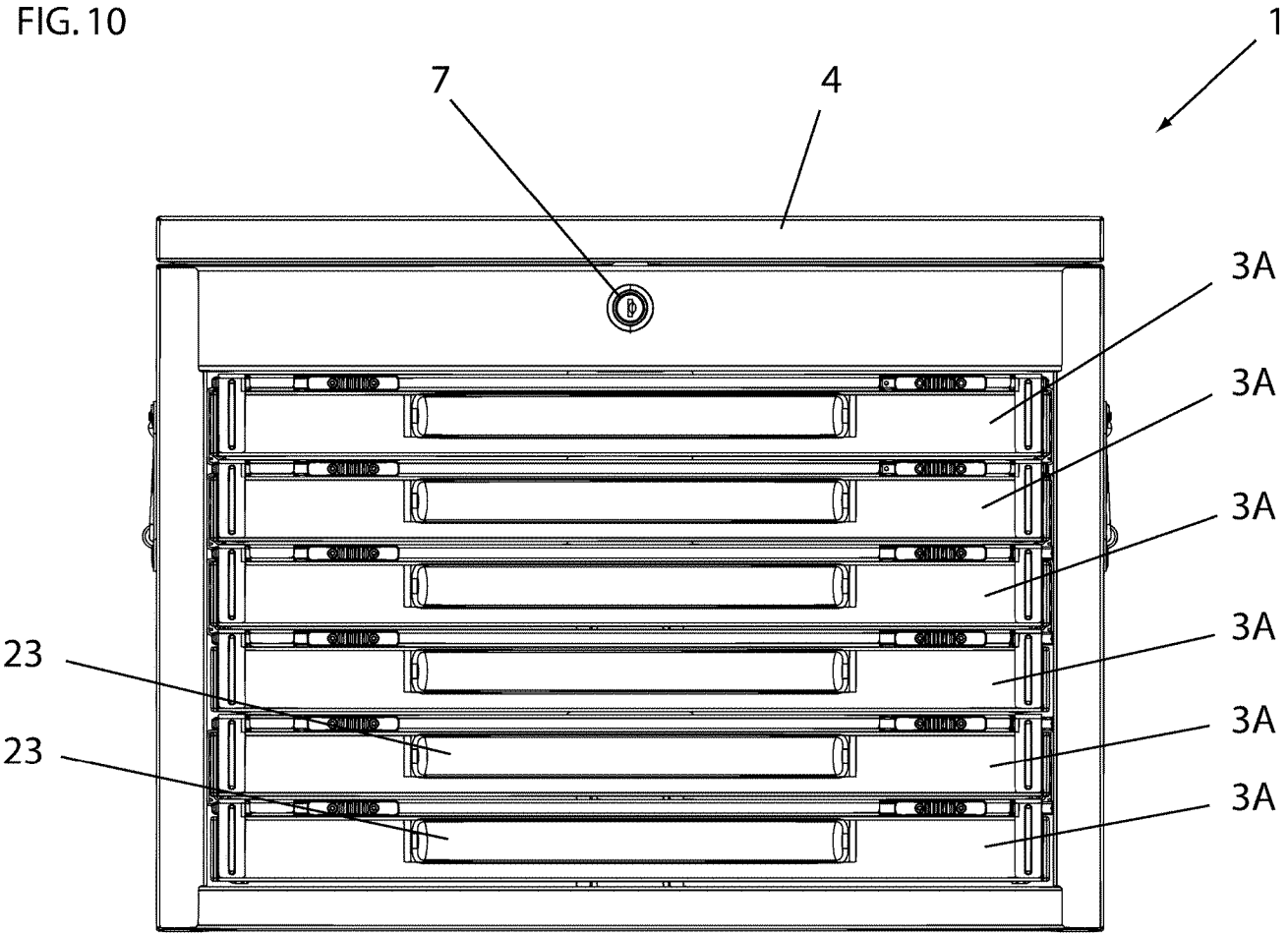
FIG. 10 is a front view of the storage cabinet with another variation of drawers installed in another configuration.
Figure 11:
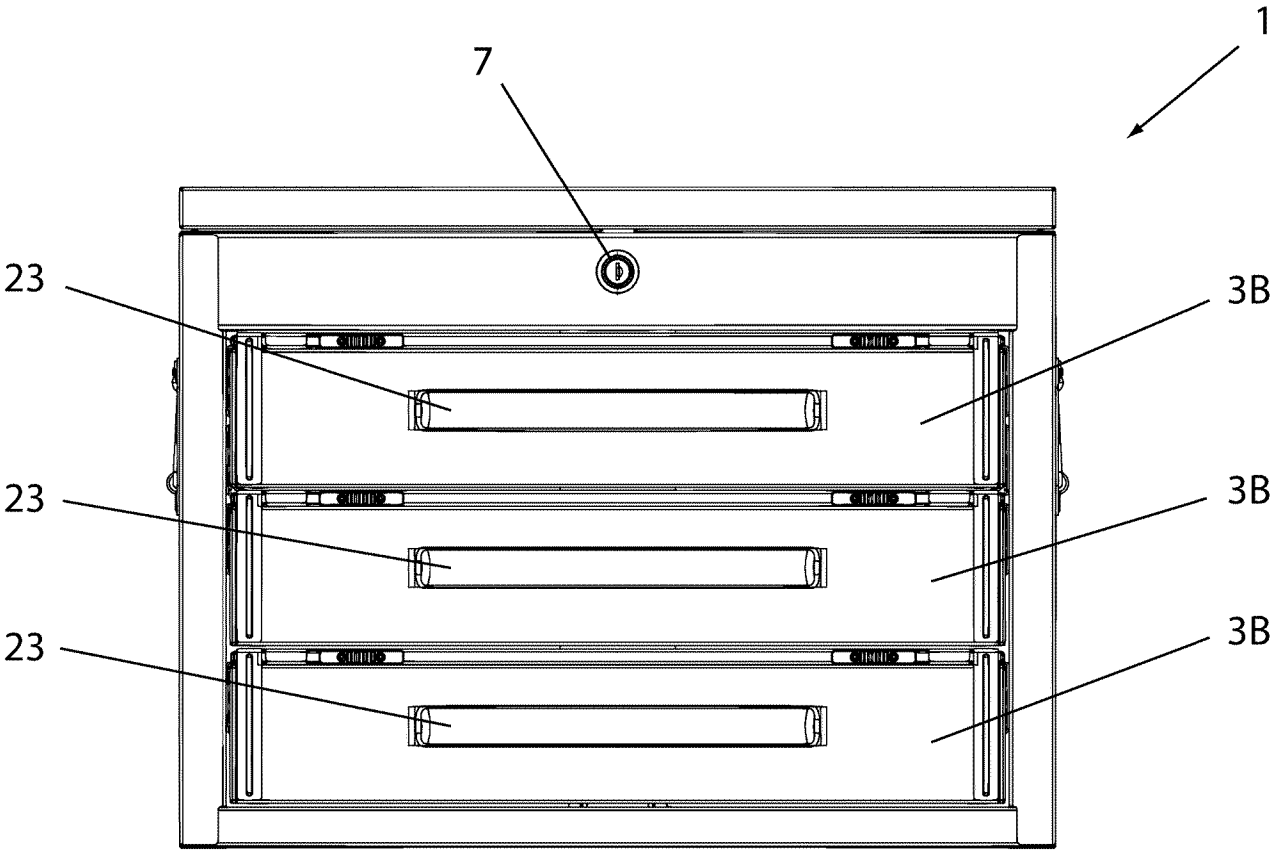
FIG. 11 is a front view of the storage cabinet with another variation of drawers installed in another configuration.
Figure 12:
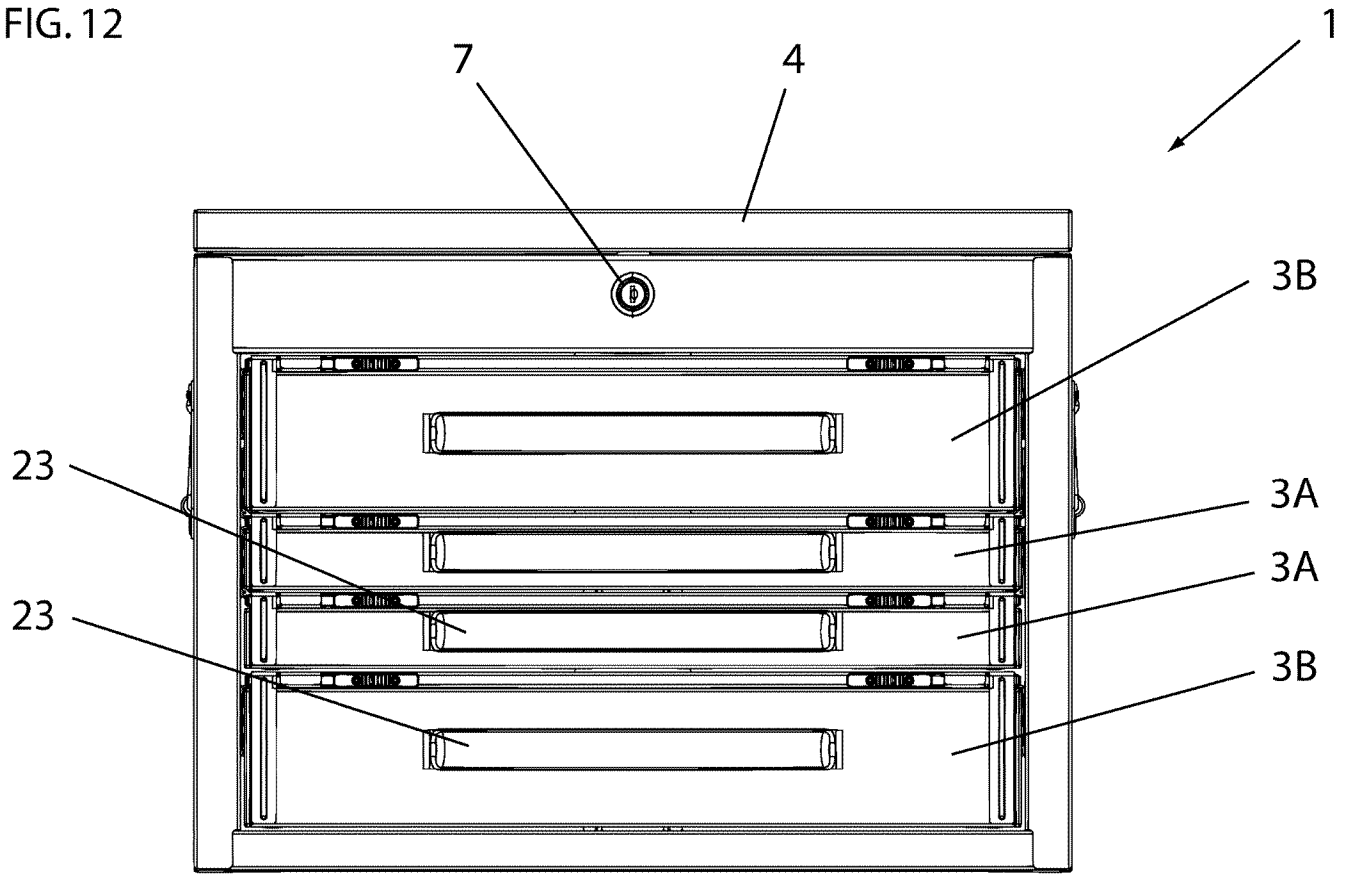
FIG. 12 is a front view of the storage cabinet with another variation of drawers installed in another configuration.

Shown in FIG. 9 is one possible configuration of the tool cabinet 1 utilizing two different size drawer assemblies 3 referred to in this and FIG. 10 & FIG. 11 & FIG. 12 as smaller drawer assembly 3A and larger drawer assembly 3B. The width and depth of smaller drawer assembly 3A and larger drawer assembly 3B are identical but their heights are defined such that two examples of smaller drawer assembly 3A will fit in the same space occupied by larger drawer assembly 3B. Consequently, it should be evident that the drawer assemblies 3 can be fit into the body 2 of the tool cabinet 1 in any of a variety of configurations, examples of which are shown further in FIG. 10, FIG. 11 & FIG. 12.

Figure 13:
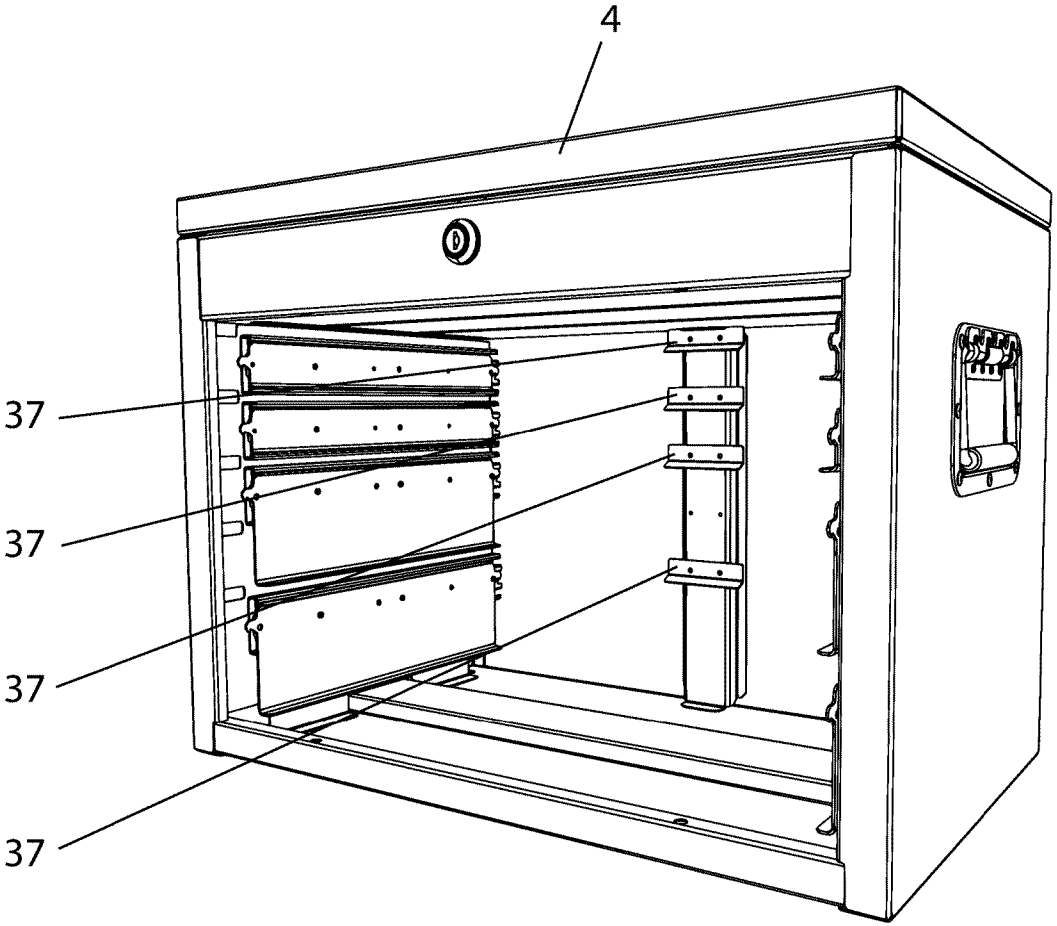
FIG. 13 is a perspective view of the tool cabinet with drawer assemblies removed.

Shown in FIG. 13 is the interior of the body 2 of the tool cabinet 1. The support features 37 for the lid 11 are located at the rear of the body 2 of tool cabinet 1. The support features 37 provide support to the rear edge of the lid 11 when the drawer 9 is extended by way of the drawer slides 36.

Figure 14:
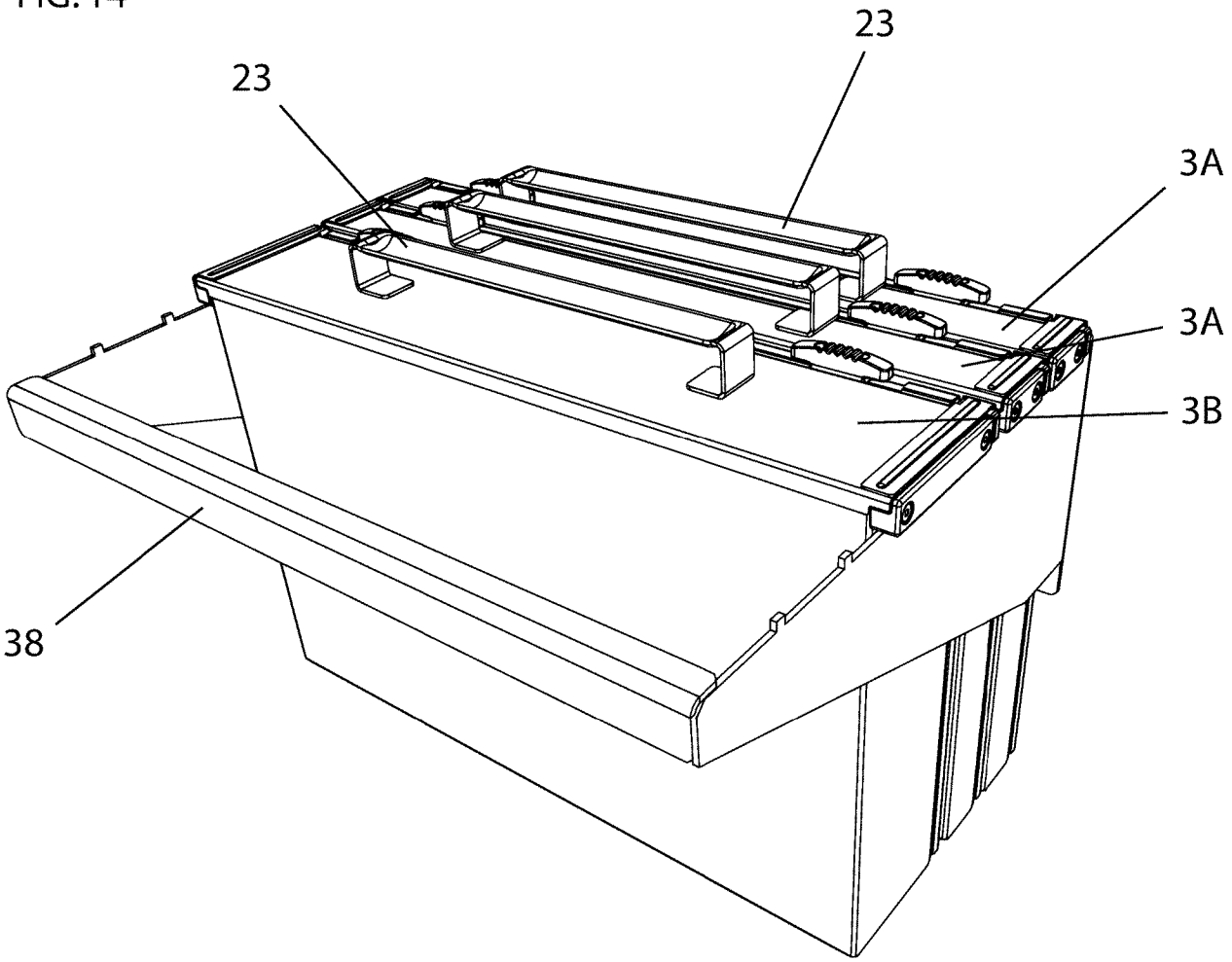
FIG. 14 is a perspective view of a bracket arrangement showing multiple drawers hung from a rack.

FIG. 14 shows another potential application in which drawer assemblies 3 are simply hung from a suitably designed structure. In this regard, a storage assembly is provided that includes tool cabinet 1 and a rack 38. Rack 38 can be mounted to a wall or other suitable structure. The same or similar rack could also be mounted to various types of vehicles such as the cargo area of a pickup truck, utility vehicle, all-terrain vehicle, other types of work trucks and other similar vehicles in a variety of locations. This would be particularly useful for transporting individual drawer assemblies to remote locations.

Figure 15:
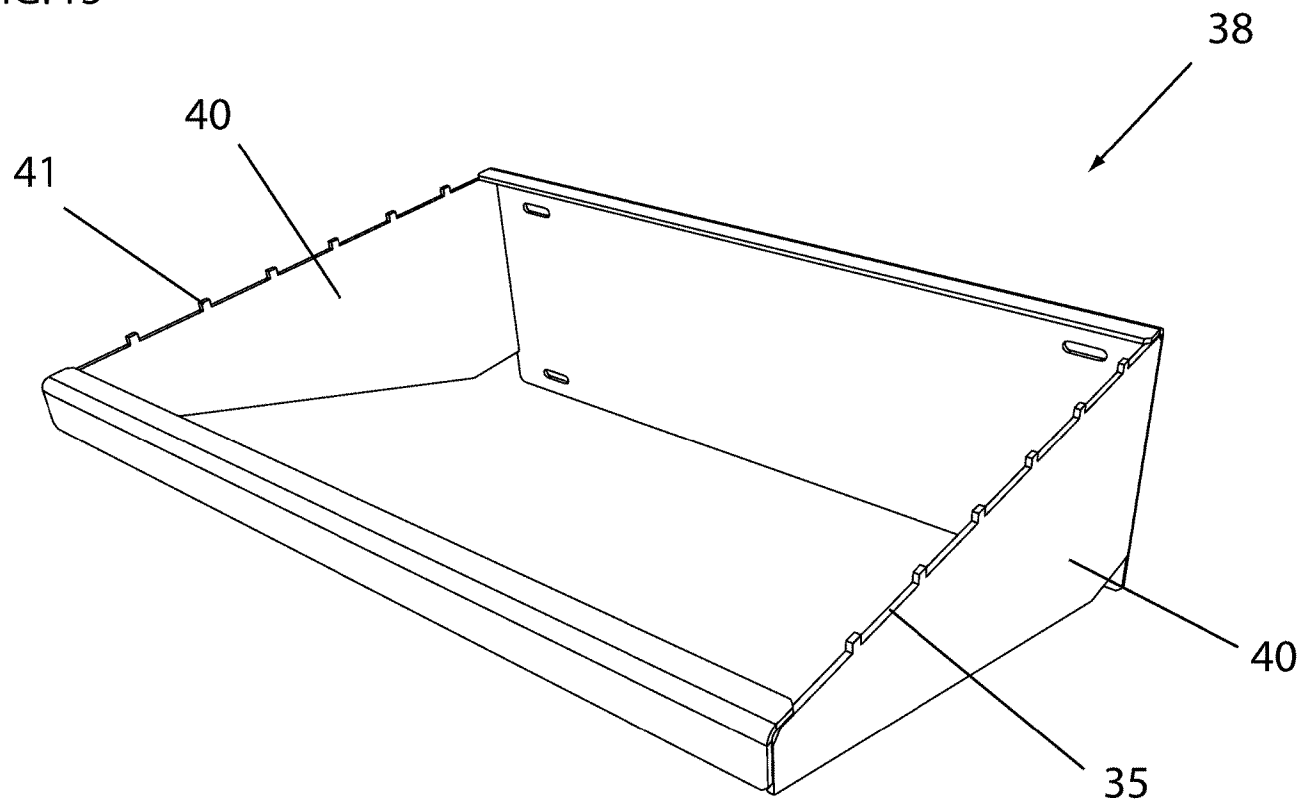
FIG. 15 is a perspective view of bracket assembly with drawers removed.

FIG. 15 shows the rack 38 from FIG. 14 without the drawer assemblies 3 installed. The notches 39 on the top edge of the bracket sides 40 are spaced such that the drawer assemblies 3 can be installed in any manner. As a way to prevent the drawer assemblies 3 from sliding on the top of the rack 38 the tabs 41 insert into the openings 26 on the backside of the extensions 25 on the drawer base 20. This feature would be particularly necessary when the rack 38 is mounted to a vehicle.

FIG. 16 through FIG. 21 show another implementation of the lid and drawer latching mechanism which utilizes a rotating latching system as opposed to the sliding mechanism configured for moving between a first position for securing the lid to the body and a second position for securing the lid to the drawer.

Figure 16:
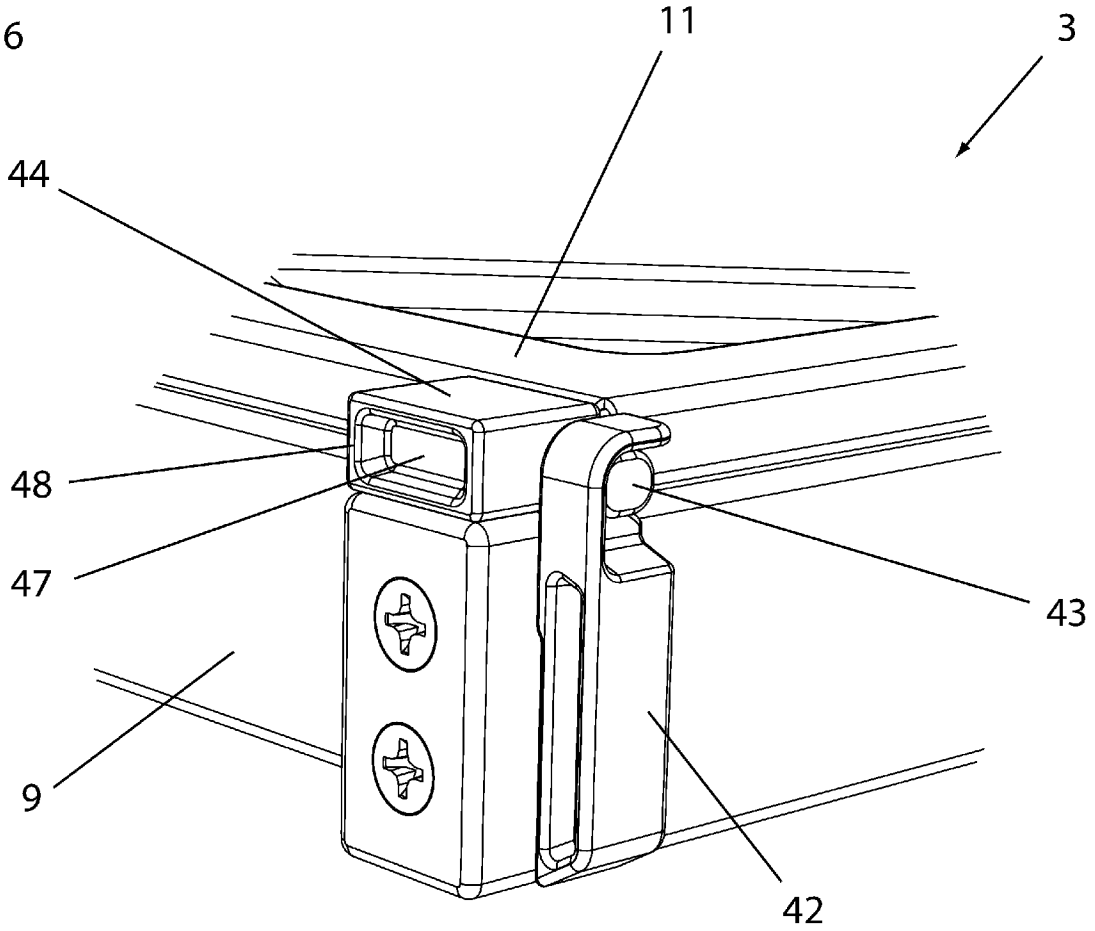
FIG. 16 is a perspective view of another implementation of the latching mechanism as a rotating member.

FIG. 16 shows the rotating latch hook 42 rotated into a position such that it captures a pin 43. Pin 43 is an integral part of lid end piece 44 which is rigidly attached to the lid 11 of the drawer 9. When rotating latch hook 42 is in this first, position, the lid 11 is locked to the drawer 9.

Figure 17:
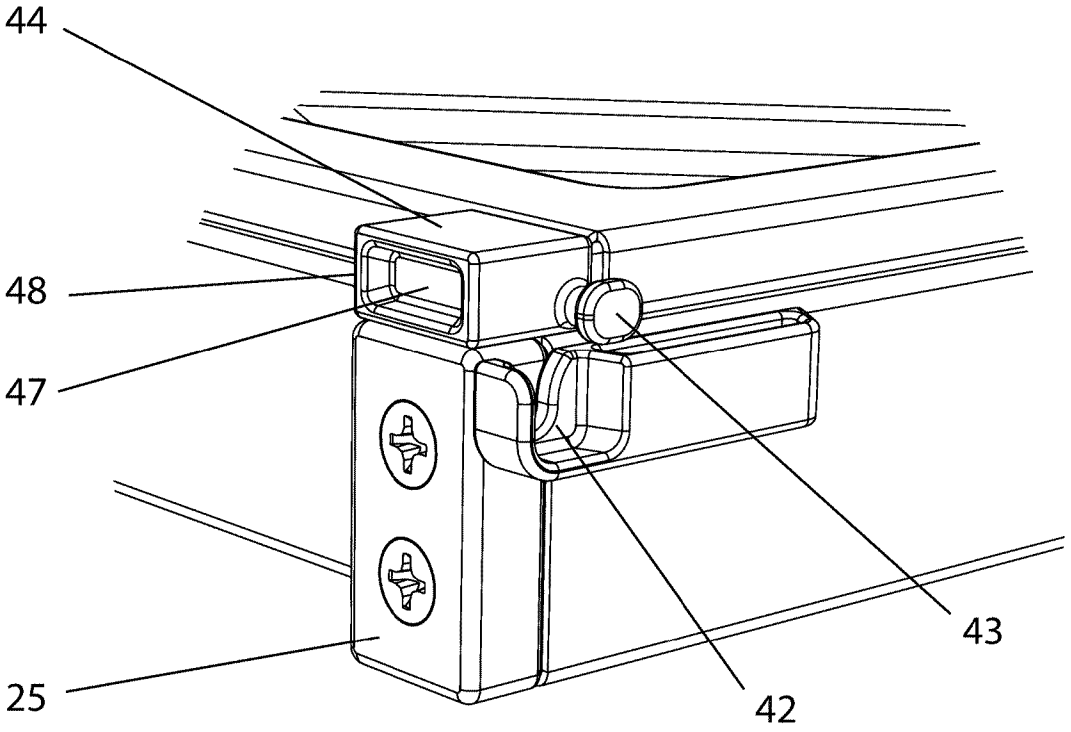
FIG. 17 is a perspective view of the latching mechanism of FIG. 16 with the latching member rotated to a different position.

FIG. 17 shows the rotating latch hook 42 rotated into a second position such that the pin 43 is released. In this position the lid 11 is released from the drawer 9 and the drawer 9 is free to move relative to the lid 11.

Figure 8:
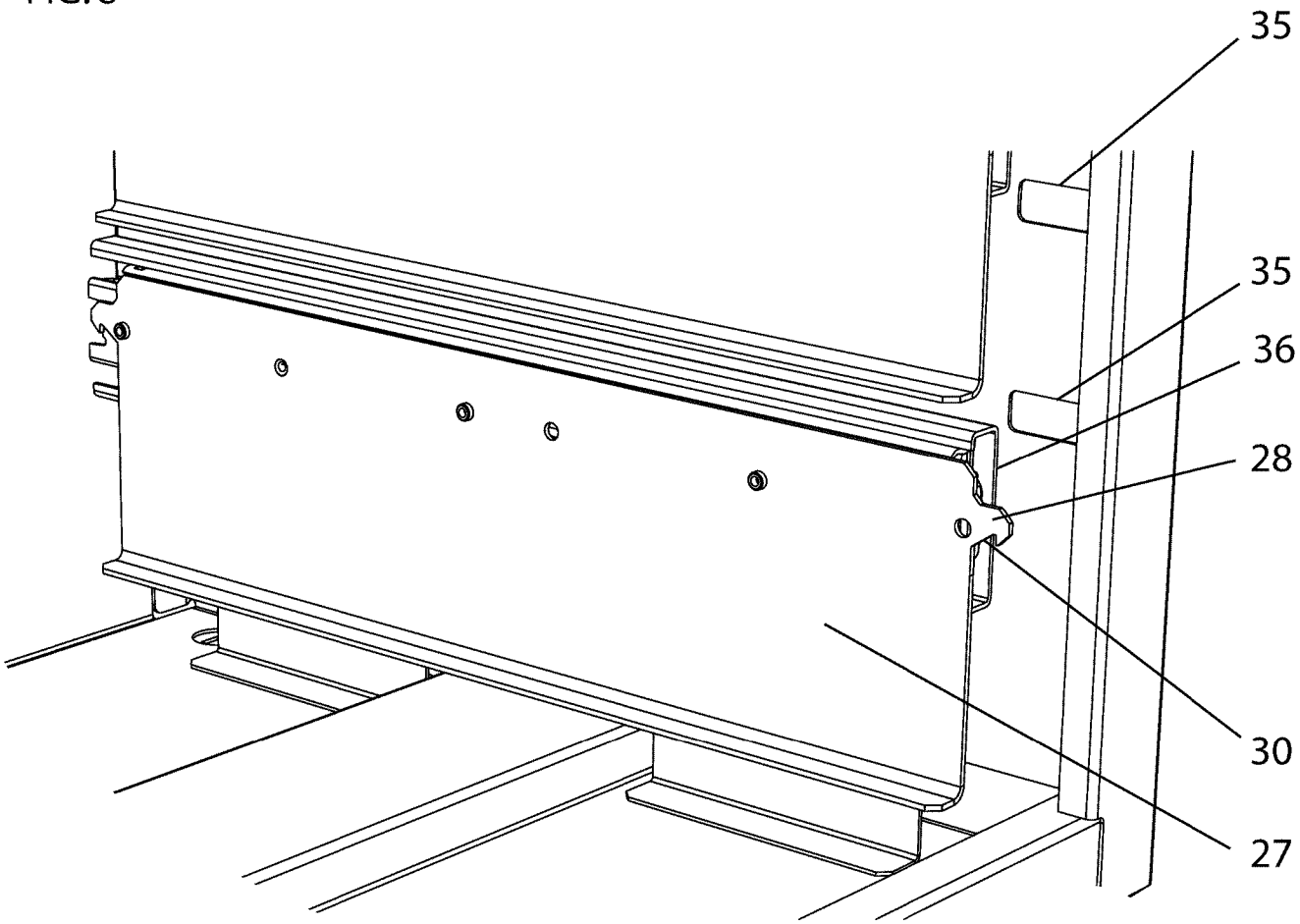
FIG. 8 is a perspective view of the storage cabinet with drawers removed showing the support brackets.
Figure 18:
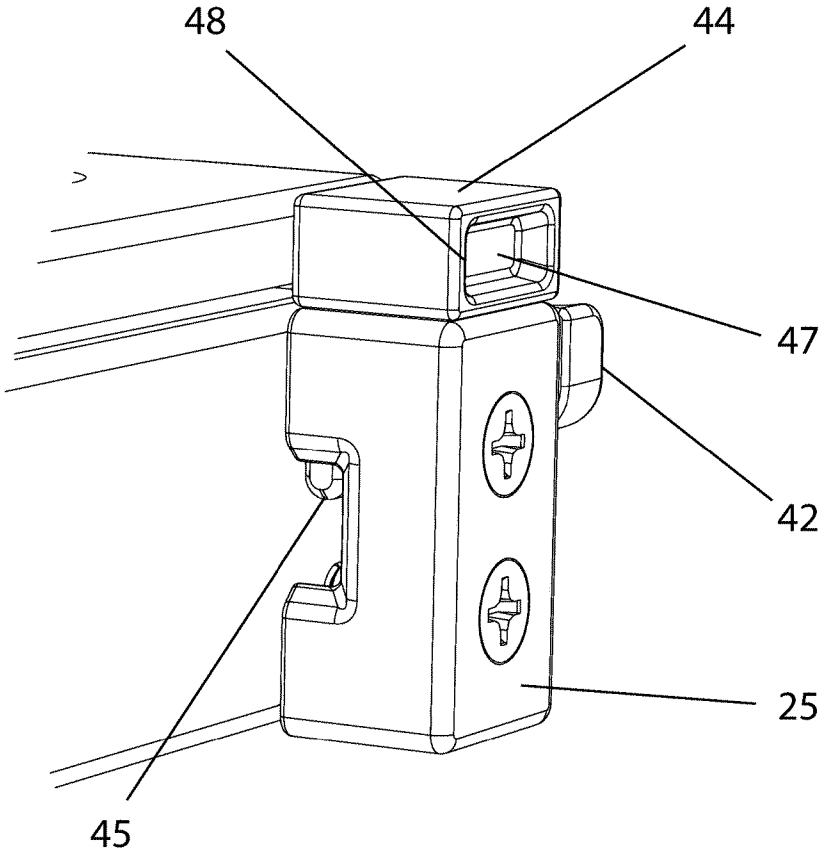
FIG. 18 is a perspective view of the feature to engage and release the drawer support brackets.
Figure 19:
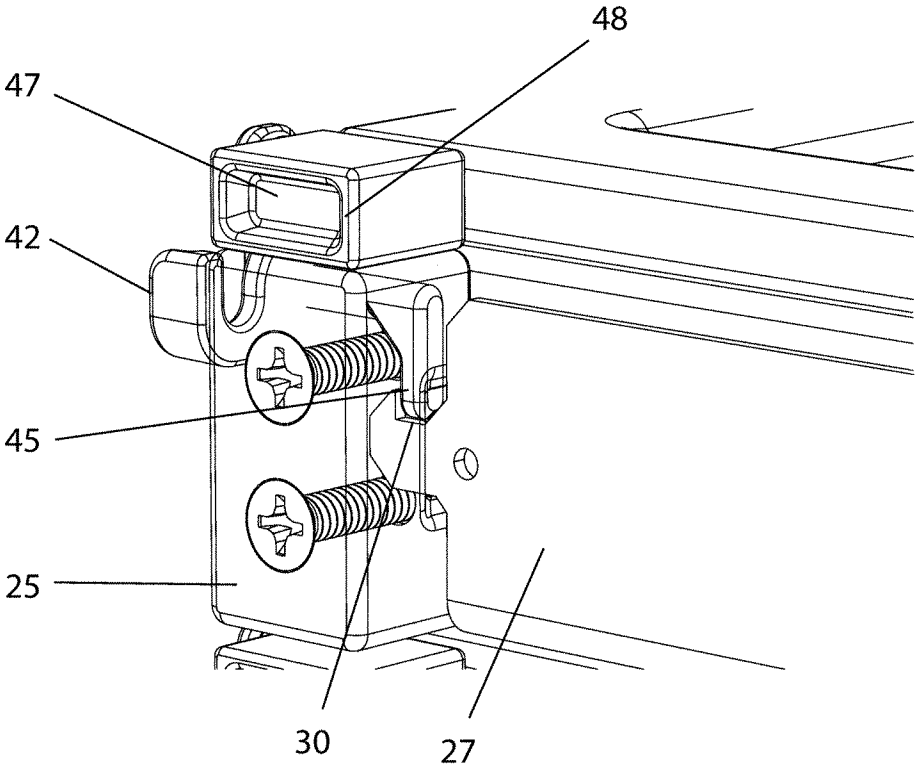
FIG. 19 is a perspective view of the latching mechanism of FIG. 16 with the drawer end piece in hidden line for improved viewing of the rotating latch member, support bracket, and lid end piece.
Figure 20:
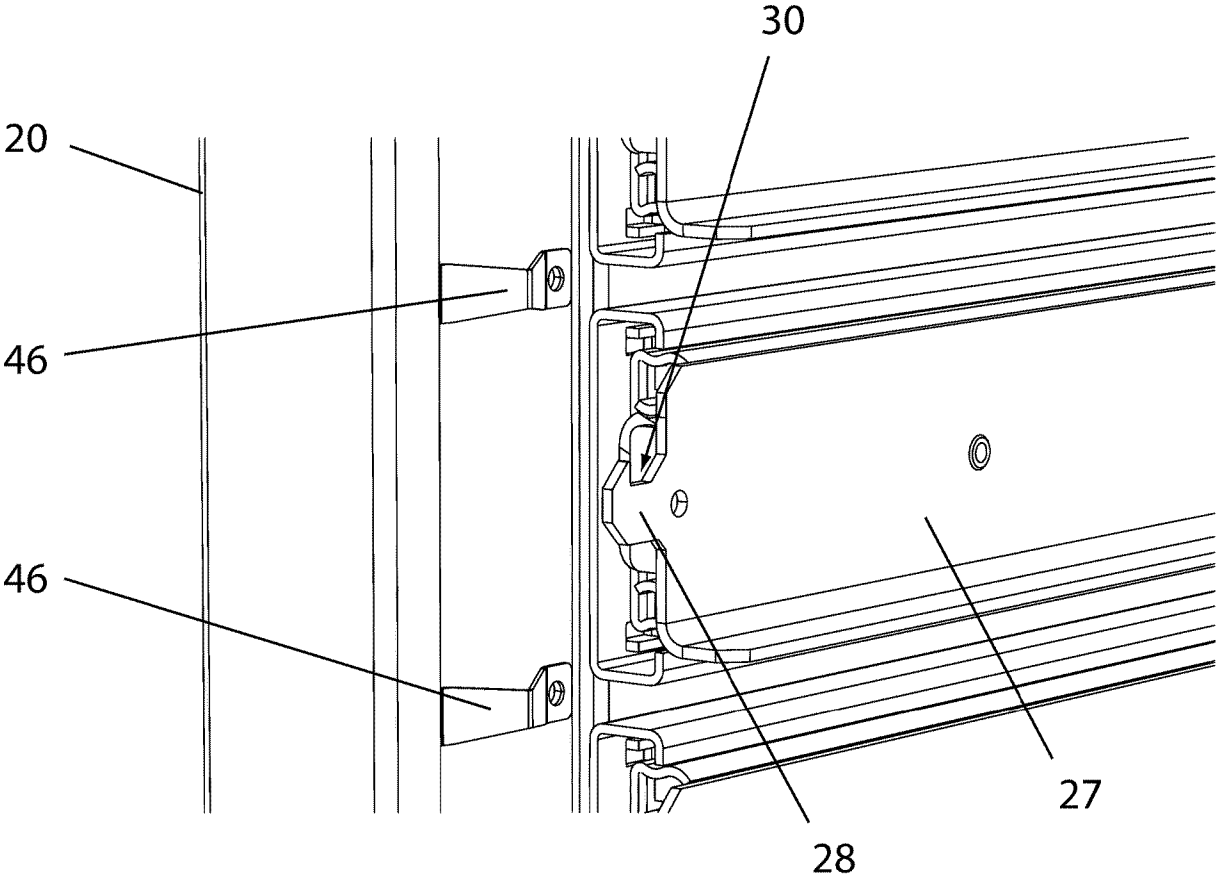
FIG. 20 is a perspective view of an interior view of the body of the cabinet with the drawers removed for the latching mechanism of FIG. 16.

FIG. 18 shows the backside of the extension 25 and the opening 26 through which tab 28 on support bracket 27 passes (see FIGS. 8 and 20). Raised protrusion 45 can be seen through the opening 26. The raised protrusion 45 is an integral part of the rotating latch hook 42 and rotates with latch hook 42 to either engage or disengage notch 30 in support brackets 27 (as shown in FIG. 19). Notch 30 is located on the topside of tab 28. When rotating latch hook 42 is rotated to the second position to release the lid 11 (as shown in FIG. 19), raised protrusion 45 engages notch 30 to lock the drawer 9 to the support bracket 27. When latch hook 42 is rotated to lock the lid 11 to the drawer 9, raised protrusion 45 disengages notch 30 and thereby releases the drawer 9 from the support bracket 27.

FIG. 19 shows extension 25 in hidden line so latch hook 42 can be seen in better detail. In this view, latch hook 42 is rotated to the second position to release the lid 11. Raised protrusion 45 can be clearly seen to be engaged in notch 30 on the topside of support bracket 27. In this orientation, the drawer 9 is locked to the support bracket 27 and is free to move relative to the lid 11 with the drawer slides 36.

FIG. 20 shows a detail of the interior of body 2 as it would be configured to utilize the rotating latch embodiment. Lid support spring 46 can be clearly seen mounted to the interior surface of the body 2. Lid support spring 46 is positioned such that it engages recess 47 in the surface of end piece 44. In this position, lid support spring 46 provides support to the lid 11 when the drawer 9 is extended by way of drawer slides 36.

Figure 21:
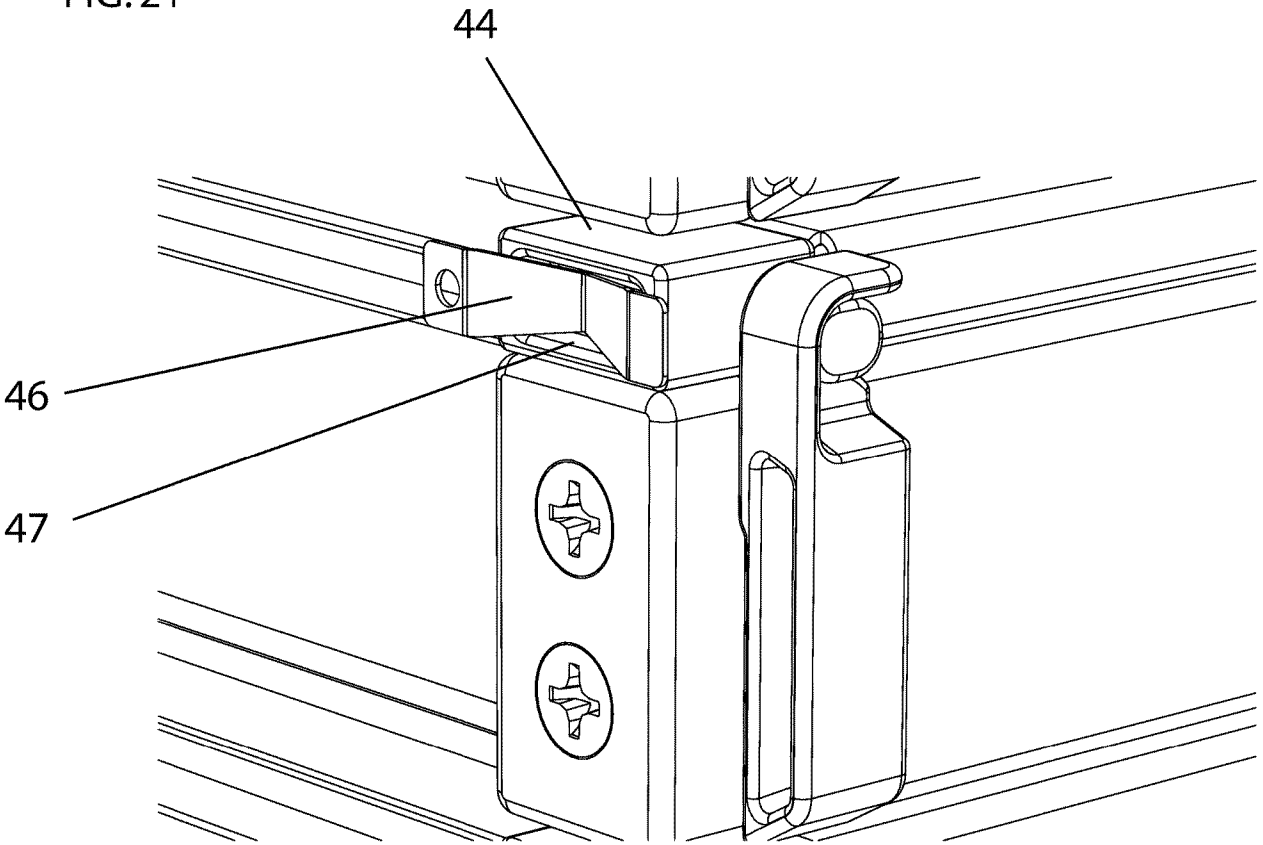
FIG. 21 is a perspective view with the body of the cabinet removed for clear viewing of the lid support springs as they would be engaged to provide support to the lid in the implementation of FIG. 16.

FIG. 21 is a view of the lid support spring 46 and end piece 44 with the body 2 hidden so the engagement of support spring 46 in recess 47 can be seen more clearly. It should be understood that when the drawer assembly 3 is removed from the body 2 edge 48 on end piece 44 will contact and depress lid support spring 46 thereby allowing the drawer assembly 3 to be removed. Edge 48 will also contact and depress lid support spring 46 when the drawer assembly 3 is inserted into the body 2.

It should be clear that similar to the other implementation, a single movement of latch hook 42 to the first position simultaneously secures the lid 11 to the body 2 and secures the drawer 9 to one of the support brackets 27. Also, a single movement of the latch hook 42 to the second position simultaneously secures the lid 11 to the drawer 9 and disengages the drawer 9 from the support brackets 27.

A tool storage cabinet has been described and illustrated above. Details of this disclosure may be changed without departing from its scope. The foregoing description and illustrations of other implementations of this disclosure are provided for the purpose of illustration only and not for the purpose of limitation.

Reference has been made throughout this disclosure to "one embodiment," "an embodiment," "embodiments" or "implementation" meaning that a particular described feature, structure, or characteristic is included in at least one embodiment or implementation of this disclosure. Thus, usage of such phrases may refer to more than just one embodiment. Furthermore, the described features, structures, or characteristics may be combined in any suitable manner in one or more embodiments.

What is claimed is:

1. A tool cabinet comprising:

a body further comprising an internal cavity;

a pair of support brackets mounted on opposite sides of the internal cavity and configured for movement relative to the body;

a drawer engagable with the pair of support brackets for movement with the pair of support brackets from a closed position to an open position; and a lid assembly further comprising a lid configured for selectively covering an inside of the drawer; and a first latch configured for moving between a first position for securing the lid to the body and a second position for securing the lid to the drawer, wherein in the first position the drawer moves with respect to the lid to the open position so that the inside of the drawer is exposed, and wherein in the second position the drawer moves with the lid toward the open position so that the drawer and the lid can be removed from the body, wherein a single movement of the first latch to the first position simultaneously secures the lid to the body and secures the drawer to one of the support brackets, and wherein a single movement of the first latch to the second position simultaneously secures the lid to the drawer and disengages the drawer from the one of the support brackets.

2. The tool cabinet of claim 1, wherein the first latch comprises a first latch bar, and further comprising a slide release latch combined to the drawer that is configured for engagement by the first latch bar, wherein when the first latch bar is in the first position the slide release latch secures the drawer with one of the support brackets, and wherein when the first latch bar is in the second position the drawer is disengaged from the one of the support brackets.

3. The tool cabinet of claim 2, wherein the first latch bar further comprises a gap, and wherein the slide release latch further comprises a first inclined protrusion, wherein the first inclined protrusion fits in the gap of the first latch bar when the latch bar is in the first position.

4. The tool cabinet of claim 3, wherein the first latch bar further comprises a camming surface for urging the inclined protrusion of the slide release latch downward when the first latch bar is moved to the second position.

5. The tool cabinet of claim 4, and further comprising a spring combined to the drawer that is configured to bias the slide release latch upward.

6. The tool cabinet of claim 5, wherein the slide release latch further comprises a second protrusion, and wherein the one of the support brackets further comprises a notch, and wherein the second protrusion is engaged with the notch when the first latch bar is in the first position to secure the drawer with the one of the support brackets.

7. The tool cabinet of claim 6, wherein the drawer further comprises a securing member, wherein when the first latch bar is in the second position, the first latch bar is engaged with the securing member to secure the lid to the drawer.

8. The tool cabinet of claim 1, and further comprising a plurality of drawers and a plurality of pairs of support brackets.

9. The tool cabinet of claim 1, wherein the lid further comprises a downturned flange on a side opposite of the first latch, and wherein the body further comprises a support feature for providing support to a rear of the lid by engaging the downturned flange of the lid.

10. The tool cabinet of claim 9, wherein the first latch comprises a first latch bar, wherein the lid further comprises of a channel for securing the first latch bar within, and the channel further comprises of an opening, wherein the lid assembly further comprises of a tab combined to the first latch bar through the opening in the channel.

11. The tool cabinet of claim 1, wherein the first latch is configured for one chosen from rotary movement between the first position and the second position and linear movement between the first position and the second position.

12. A tool cabinet comprising:

a body further comprising an internal cavity;

a pair of support brackets mounted on opposite sides of the internal cavity and configured for movement relative to the body;

a drawer engagable with the pair of support brackets for movement with the pair of support brackets from a closed position to an open position; and a lid assembly further comprising a lid configured for selectively covering an inside of the drawer; and a first latch configured for moving between a first position for securing the lid to the body and a second position for securing the lid to the drawer, wherein in the first position the drawer moves with respect to the lid to the open position so that the inside of the drawer is exposed, and wherein in the second position the drawer moves with the lid toward the open position so that the drawer and the lid can be removed from the body, wherein the first latch is configured for securing the lid to a first side of the body and the second latch is configured for securing the lid to a second side of the body.

13. A tool cabinet comprising:

a body further comprising an internal cavity;

a pair of support brackets mounted on opposite sides of the internal cavity and configured for movement relative to the body;

a drawer engagable with the pair of support brackets for movement with the pair of support brackets from a closed position to an open position; and a lid assembly further comprising a lid configured for selectively covering an inside of the drawer and a first latch configured for moving between a first position for securing the lid to the body and a second position for securing the lid to the drawer, wherein in the first position the drawer moves with respect to the lid to the open position so that the inside of the drawer is exposed, and wherein in the second position the drawer moves with the lid toward the open position so that the drawer and the lid can be removed from the body, wherein the first latch rotates between the first position and the second position, and wherein the first latch comprises a rotating latch hook and a raised protrusion, wherein the rotating latch hook is combined to the drawer, wherein the lid comprises a pin, wherein the rotating latch hook engages on the drawer engages the pin on the lid when the rotating latch hook is in the first position to secure the lid to the drawer, wherein at least one of the support brackets comprises a tab with a notch, wherein the raised protrusion of the rotating latch engages the notch on the tab of the support brackets to secure the drawer to at least one of the support brackets when the rotating latch hook is in the second position.

14. The tool cabinet of claim 13, wherein the first latch moves linearly between the first position and the second position.

* * * * *